US005159307A

United States Patent [19]

Wells et al.

[11] Patent Number: 5,159,307

[45] Date of Patent: Oct. 27, 1992

[54] ELECTRIC MOTOR PROTECTOR

[75] Inventors: Robert M. Wells, Akron, Ohio; Alton R. Wells, Lauderdale-by the Sea, Fla.

[73] Assignee: Mighty Mite Controls, Inc., Akron, Ohio

[21] Appl. No.: 744,320

[22] Filed: Aug. 13, 1991

[51] Int. Cl.[5] ..... H01H 61/04; H01H 37/52

[52] U.S. Cl. ..... 337/85; 337/86; 337/95

[58] Field of Search ..... 337/85-97, 337/102, 103, 112; 310/68 C

[56] References Cited

U.S. PATENT DOCUMENTS 3,609,618 9/1971 Wells ..... 337/95

*Primary Examiner*—Harold Broome

*Attorney, Agent, or Firm*—Oldham, Oldham & Wilson Co.

[57] ABSTRACT

The electrical motor protector includes a housing being constructed of an electrical conductive material and having a first electrical contact disposed therein. Within the housing, a movable cantilever assembly is disposed and carries a second electrical contact thereon. Upon malfunction or overheating of the motor, the motor protector will break electrical connection between the first and second contacts to thereby interrupt electrical current to the motor, to render the motor inoperative.

The cantilever assembly will be responsive to temperature wherein overheating of the motor will act to break the electrical connection between the first and second contacts, after which the motor will have a chance to cool before electrical connection is remade. The cantilever assembly includes first and second cantilevers which act in conjunction with one another to increase the cycle time of the device as well as providing a variety of other benefits and advantages.

12 Claims, 3 Drawing Sheets

ELECTRIC MOTOR PROTECTOR

BACKGROUND OF THE INVENTION

The present invention is directed to an electric motor protector utilized to break electrical connection to the motor in the event of overheating, overload or other malfunction. More particularly, the invention is directed to a slow make/slow break motor protector which has been improved to facilitate protection of the motor and to provide safety in the use thereof. Motor protectors have long been utilized in conjunction with electric motors to provide a method to eliminate electrical power to the motor in the event that the motor malfunctions. Typically, an electrical motor will include stator coils comprising both a starting winding and main windings. The motor protector is electrically coupled with these windings so as to break the circuit supplying electrical energy to the windings upon the occurrence of a malfunction such as a locked rotor, motor overload, or other similar malfunctions which may produce overheating of the motor. Such overheating may subsequently lead to the motor presenting a substantial safety hazard if a suitable motor protector is absent from the circuit.

The motor protector is usually connected in series to the windings of the stator coil which may include both the start and main windings. In contrast to a fuse-type device utilized as a circuit breaker, motor protectors will effectively break the circuit upon malfunction of the motor, after which the motor will be given a time period in which to cool. Upon coolings the motor protector will act to electrically reconnect the circuit to enable operation of the motor. If the malfunction causing actuation of the motor protector has not been corrected, another similar cycle of breaking the circuit, cooling and reconnecting the circuit will be performed. This process will continue until the motor malfunction is corrected.

There are known various motor protector devices in the prior art which function substantially as described above, and which have been in continuous use over the past few decades without any substantial change in their design. Several known devices include what may be termed a "snap action" type of motor protector, such as that produced by Texas Instruments in their motor protector model 2AM. In these types of devices, electrical connection is made between contacts formed in association with the motor protector wherein one contact is movable relative to the other so as to make or break the electrical circuit. The structure on which the movable contact is positioned is made to go through a center position in opposition to high mechanical stress, after which the component and contact associated therewith will snap to make or break the electrical circuit through the motor protector. These devices normally have a wide differential between open and closed contact modes wherein the intermediate movement of a movable contact is substantial to enable the snapping phase to occur so as to make or break the circuit.

Another device known in the art may be termed "slow" make/slow break device wherein a cantilever arm is made to move slowly in response to temperature differentials encountered in the system. The cantilever arm carries a contact relative to a fixed contact associated with the motor protector, wherein movement of the cantilever arm will cause making or breaking of the electrical connection between contacts. In this type of construction, the cantilever arm moves slowly and has a very small movement differential between open and closed positions. The cantilever arm is constructed such that it will move in response to temperature differentials encountered. General overheating of the motor will cause operation of the motor protector to break the electrical circuit in a gradual manner. Additionally, the motor protector may include a shunt offset portion which is heated upon a malfunction such as a locked rotor condition in the motor so as to radiate heat to the cantilever arm to effect movement thereof so as to open the contacts and break the electrical circuit quickly. After breaking the electrical circuit, the motor along with the motor protector will cool such that the cantilever arm will also cool and will slowly move to its initial position wherein the contacts will be closed and the electrical circuit will be made.

In the above devices, several deficiencies have been found which have reduced their effective use with various electrical motors and the particular applications in which they are used. Although motor design has changed significantly in the recent past, the design of the motor protectors utilized therein have remained substantially constant in the recent past. For example, the design of motors has been drastically modified in response to escalating costs and higher efficiency requirements. Materials have been taken out and material substitutions made to maintain relatively low costs, the result of which tend to make the motors run hotter and limit the useful life thereof. Similarly, the electrical efficiency of the motor has been of increasing importance and actual mandates imposed by industry regulation have resulted in substantial internal design changes in these motors. The ultimate effect of these motor design changes have resulted in motors which will run hotter and at higher speeds, and these new motors are significantly more burdensome of the motor protectors than previously encountered. The effect of the motor design changes referred to above on the motor protectors which have been relied upon in the prior art is to reduce the useful life of the motor protectors as well as to make it harder to meet the regulations and requirements regarding such motor protectors as set by the Underwriters Laboratory (UL). As for all motor protectors, the UL requirements provide for an 18 day testing period wherein the motor is placed in a locked rotor condition and the performance of the motor protector is observed and analyzed over the 18 day period. The 18 day test is required of all motor protectors and must be verified for each motor with which the protector is to be used. The stringent requirements of the 18 day test results in the necessity to provide motor protectors which are rugged and durable in their operation, and which maintain predetermined operating characteristics for the entire 18 day period. As an example, all electric motor protector UL requirements involve 18 day, 24 hour per day continuous locked rotor operation as a minimum, and after the 18 day period the motor must be capable of running a normal operation with the rotor unlocked at the conclusion of the 18 day test. UL also requires the motor manufacturers to submit two motors when a temperature tolerance of $\pm 7°$ C. is relied upon. As every model of motor on which a motor protector is to be used, must be tested under the UL requirements, submission of two only one motor need to be submitted when the temperature tolerance of $\pm 5°$ C. is used. It is therefore also a design consideration of the motor protector to maintain the lower temperature tolerance by calibration methods so as to reduce the cost of testing under the UL requirements. As an example, the UL 18 day motor locked rotor test for a class motor is conducted in the following manner. With the locked rotor condition, the operation of the motor will quickly result in high operating temperatures which are designed to be prevented by the motor protector. Thus, with a locked rotor condition, the motor protector will be cycled through its operation repeatedly and will be relied upon to break the electrical circuit supplying operating power to the motor. Upon breaking of the circuit, the motor and motor protector will gradually cool after which the motor protector will act to recouple electrical power to the motor, this cycle being repeated over the entire 18 day test. During the first hour of the UL stator testing, the stator peak temperature must not exceed a maximum of 225° C. Additionally, during the first three days of the test, the peak temperature must not exceed 200° C. and the average temperature must not exceed 175° C. Normally, the UL testing procedure monitors the temperature using a type J iron and constantan thermocouple located on the motor windings. Conventionally, the 12 o'clock thermocouple position on the stator windings is utilized as the point where temperatures are measured as it is normally the hottest location on the motor.

It should be evident that the UL requirements including the 18 day locked rotor test place design requirements on the motor protectors wherein the cycle time between breaking of the electrical circuit by the motor protector and subsequently recoupling the circuit should be long enough to allow the motor to cool substantially before operation begins again. In this way, the average temperatures are maintained at a point well below the UL maximums. Additionally, the on-time wherein the electrical circuit is completed cannot be so long as to allow the peak temperatures to exceed the UL maximums. Thus, ideally the motor protectors should provide durable and repeated performance wherein the on-time of the circuit in a locked rotor condition is maintained very short to keep peak temperatures down, and the cycle time is relatively long, to allow sufficient cooling of the motor to maintain average temperatures below the UL limits. In the known devices, the snap action type motor protectors have a cycle time of 2 to 2½ minutes which has been found to be a very desirable cycle time to allow sufficient cooling (but also to not allow cooling to such a degree that restarting of the motor will have adverse effects thereon). Although the snap action motor protectors have a relatively lengthy cycle time, other deficiencies are possible in their operation. For example, the construction of the snap action type motor protector is such that if the device fails, the wide differential between open and closed positions of the movable contact is lost early in the cycle life of the device. After such differential is lost, the device begins to act like a "creeper" or slow make/slow break device wherein the small contacts provided thereon are not designed for such rugged fast cycling performance and so leading to complete failure of the device. Additionally, as the movable contact goes through the center position which is an area of high mechanical stress, it is possible for the device to fail in a closed position. In this situation, the electrical circuit will be made to allow operation of the motor without the motor protector operating so as to create a very dangerous condition as the motor continues unabated to overheat.

Alternately, in the prior art slow make/slow break devices, it has not been possible to provide a long time duration cycle time which corresponds to the snap action type devices. As an example, one known slow make/slow break device manufactured by assignee of the present invention in their Model 325, shows a device which has a cycle time of approximately 50 seconds. This cycle rate is relatively short, compared to some snap action type devices which renders them disadvantageous for some motor applications. The advantage of the slow make/slow break device is found in that if the device fails, it will fail in an open circuit breaking condition so as to render the motor inoperative and avoid any potential dangerous conditions thereby.

SUMMARY OF THE INVENTION

Based upon the foregoing, there has been found a need to provide a motor protector which includes the desirable aspects of the prior art devices, and which avoids or eliminates the deficiencies found therein. The present invention is directed to a slow make/slow break device which dramatically increases the cycle time of the device to coincide with that of a snap action type device, but which also has the advantageous characteristics of a slow make/slow break device. It is therefore a main object of the invention to provide a motor protector which provides a desirable and longer cycling rate in a slow make/slow break device.

It is yet another object of the invention to provide a motor protector which is highly reliable in its operation and facilitates compliance with standards imposed on such motor protectors such as the UL requirements.

It is yet another object of the invention to provide a motor protector wherein the operating characteristics are improved to greatly extend the useful life thereof in a simple and cost effective construction.

It is yet another object of the invention to provide a motor protector having a design to extend the life of the electrical contacts therein and to avoid the problem of contacts welding in devices of this type.

The electrical motor circuit breaker device of the invention comprises a housing being constructed of an electrical conductive material and having a first electrical contact disposed therein. Within the housing, a movable cantilever assembly is disposed in the housing and carries a second electrical contact thereon. The motor protector may be electrically coupled in series with the stator winding or windings of the motor, wherein electrical connection will be completed between the first and second electrical contacts. Upon malfunction or overheating of the motor, the motor protector functions to break the electrical connection between the first and second contacts and thereby interrupts the current to the start windings and/or stator windings to render the motor electrically inoperative.

The movable cantilever assembly may include first and second cantilevers constructed of a material which exhibits predetermined characteristics in response to a physical variable. In a preferred embodiment, the first and second cantilevers will act in conjunction with one another in response to variations in temperature such that overheating of the motor or increased current flow due to a locked rotor condition will result in breaking of the electrical connection between the first and second contacts. The movable cantilever assembly also includes a current shunt arm having first and second ends being constructed of an electrically conductive material. In the assembly, the first cantilever and current shunt arm are fixed relative positioned to the housing so as to extend therein adjacent one another. The second cantilever is coupled to a second end of the shunt arm so as to extend adjacent to and in an opposed manner to the first cantilever. The second electrical contact is also electrically coupled to the shunt arm and second cantilever assembly at the second end thereof and is positioned relative to the first contact to enable electrical connection to be made therebetween. The first and second cantilevers in the assembly are positioned in operative relationship to one another such that change of the physical temperature variable to which the material making up the cantilevers is responsive will move the second contact into and out of electrical connection with the first contact to complete or break the electrical circuit respectively.

In the preferred embodiment, the physical variable to which the cantilever assembly will be responsive is temperature wherein overheating of the motor will act to break the electrical connection between the first and second contacts, after which the motor will have a chance to cool before electrical connection is remade. The shunt arm may be designed to include an offset portion of current shunt which will heat rapidly upon the occurrence of a malfunction in the motor such as a locked rotor condition. Heating of the current shunt creates the change of the physical variable to which the first and second cantilevers are responsive to enable making and breaking of the electrical connection between the first and second contacts as previously described. The particular design of the motor protector is such that the first and second cantilevers also act in conjunction with one another to dramatically increase the cycle time of the device as well as a variety of other benefits and advantages which will be described more fully hereinafter. The motor protector of the invention is relatively simple in its construction and yet provides the operating characteristics desired in a cost effective manner.

BRIEF DESCRIPTION OF THE DRAWINGS

The objects and advantages of the present invention will become apparent upon a further reading of the detailed description herein in conjunction with the drawings wherein.

DETAILED DESCRIPTION OF THE INVENTION

Figure 1:
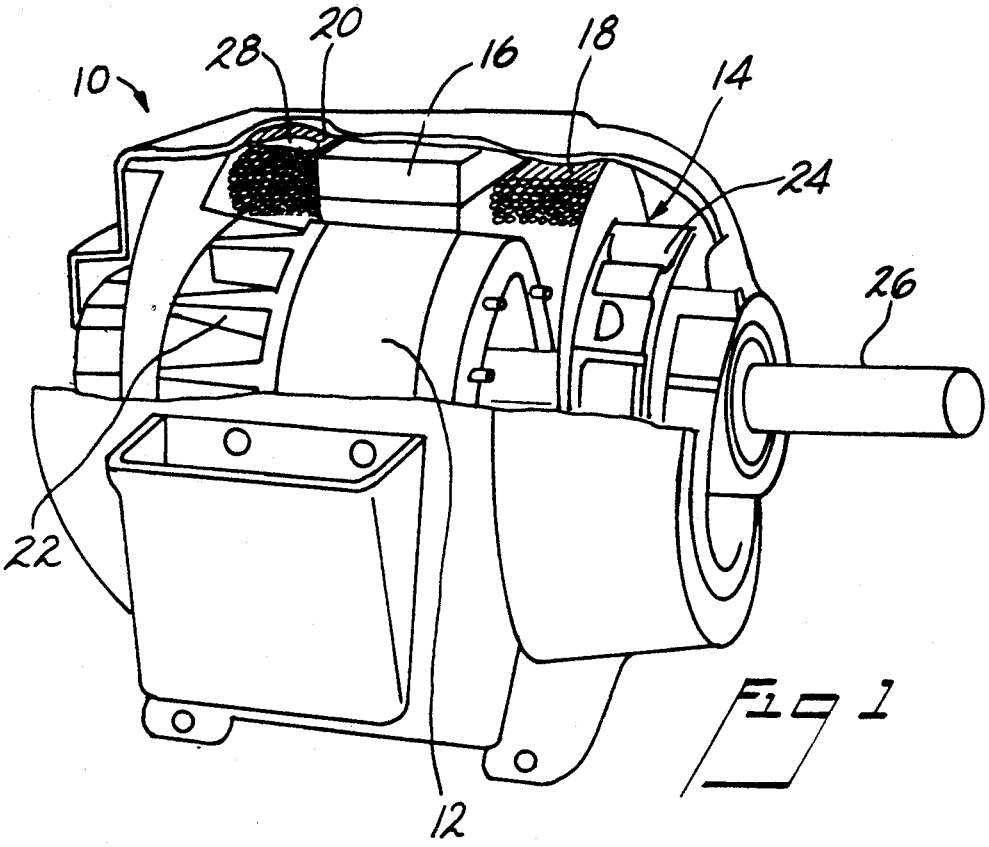
FIG. 1 is a partially cut away perspective view of an electric motor showing the position of the motor protector of the invention as utilized therewith.

Turning now to FIG. 1, there is shown a conventional type electric motor for converting electrical energy into mechanical energy. The motor protectors of the present invention are normally used on motors of the split capacitor, permanent split capacitor, capacitor start or a variety of other conventional motors depending upon the classification and the application in which they are to be used. The motor protector of the present invention is also normally used with fractional horse power electric motors, and usually within the range of $\frac{1}{8}$ h.p. to $\frac{2}{3}$ h.p. although the invention is not limited thereto. As seen in FIG. 1, a conventional motor 10 includes a rotor 12 which is rotatably mounted in a frame or stator 14. The stator 14 includes a stator pole piece 16 as well as stator windings 18 and 20 positioned therearound. Cooling fins 22 and 24 may be provided on the rotor for rotation therewith to provide cooling during operation of the motor. An output shaft 26 coupled to rotor 12 will deliver the mechanical power from the motor 10.

In a conventional motor of this type, the motor protector 28 is placed in series with the start and main stator windings 18 and 20 of the motor. Most conventional electric motors today have both start and main stator windings and the motor protector 28 will be connected in series with both. In this way, the device 28 protects against locked rotor start and also against running overloads which may be caused for a variety of reasons such as dry bearings, non-circulation of coolant air or similar malfunctions. A running overload will cause the motor to overheat, and in this way will slowly induce cycling of the motor protector 28 so as to break the electrical circuit and the flow of electric current to the stator and/or start windings. Similarly, a locked rotor condition will impose a tremendous strain on the motor 10 such that the motor will draw high amperage current. The motor protector 28 connected in series with the stator windings will thus be exposed to this large current, wherein operation and cycling of the motor protector 28 will occur very rapidly. As an example, an electric motor which typically draws 6 amps under normal operation, may draw up to 35 amps upon a locked rotor condition. It should be evident that a locked rotor condition will quickly result in a significant safety hazard if the motor is not rendered inoperative very quickly. It is therefore desirable to provide a very fast opening time to break the electrical connection made through the motor protector 28 upon the occurrence of a locked rotor condition. Thus, the motor protector of the invention is a dual functioning protector in that the motor circuit will be opened gradually upon the occurrence of over temperatures due to a running overload or the like and will also be quickly opened upon sudden motor locked rotor condition as desired.

Figure 2:
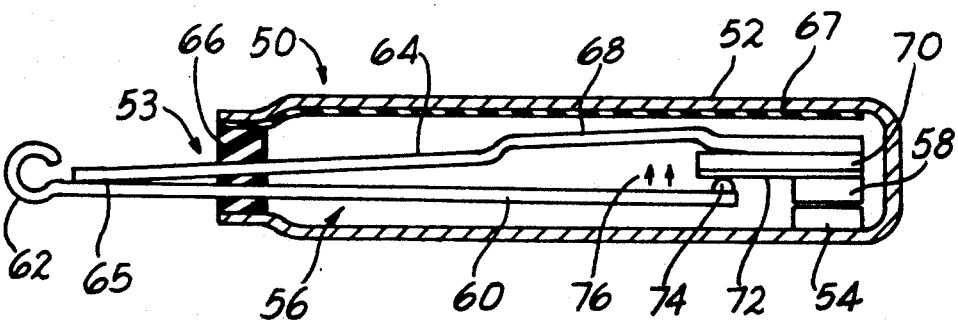
Fig 2 (Prior Art)
FIG. 2 shows an enlarged cross sectional view of a prior art slow make/slow break motor protector.

Turning now to FIG. 2, there is shown a prior art slow make/slow break motor protector 50. The motor protector 50 includes an outer housing 52 which is constructed of an electrically conductive material such as copper or the like. The housing 52 is normally laced onto the stator windings of a motor with a cord or similar fastening means, and may include a Mylar sleeve to electrically insulate the housing from the varnish coated magnetic windings of the stator. The housing 52 includes an open end 53, and also has disposed therein a first electrical contact 54 positioned within the housing 52 at an opposed end from the open end 53. The first contact 54 is electrically connected to the housing and will act to complete the electrical circuit through the housing 52 as will be hereinafter described. Positioned through the open end 53, is a movable cantilever assembly generally designated 56, which is designed to carry a second electrical contact 58 thereon in a position relative to the first contact 54 to enable electrical connection to be made or broken by movement of the cantilever assembly 56 within the housing 52. The cantilever assembly 56 includes a first cantilever 60 which is constructed of a material adapted to move in response to temperature changes. The first cantilever 60 is constructed of a bi-metallic material which has a high flexibility and reacts to temperature changes by means of differential expansion between the two or more metallic materials making up the bi-metallic cantilever means. Upon an increase in temperature, the bi-metallic cantilever blade 60 will react in response to the temperature differential to bend upwardly. First cantilever 60 extends from the open end 53 to enable electrical connection with a source of electrical power. The cantilever assembly 56 also includes a shunt arm 64 which is coupled to the cantilever 60 at a first end thereof as shown at 65. At the open end 53, both the cantilever blade 60 and shunt arm 64 are electrically insulated from the housing 52 by means of an insulating material 66 positioned therearound. Also, there may be provided an insulating layer 67 positioned on the upper portion of the housing 52 to ensure electrical isolation between the shunt arm 64 and housing 52 during cycling of the device. The shunt arm 64 is constructed of an electrically conductive material and includes an offset shunt portion 68. At the opposed end of the cantilever arm 64 is positioned a tab 70 which may also be constructed of an electrically conductive material similar to the shunt arm 64. In the prior art device, the tab 70 has a length such that it is positioned at the opposed end of the shunt arm 64 and extends approximately to the shunt offset 68. Disposed on the tab 70 is also a layer of insulating material 72 which may be a mica insulator. The second electrical contact 58 is then positioned at the opposed end of the shunt arm 64 from its fixed location 65 so as to be in a position relative to the first contact 54 as previously described. As seen in FIG. 2, the first cantilever arm 60 has a length such that it extends to a position relative to the shunt arm 64 to enable the cantilever arm 60 to operate on the tab 70 having an insulating layer 72 thereon. The cantilever arm 60 may include a dimple or other construction 74 on its opposed end relative to the tab 70 to create a bearing surface for consistent and reliable operation of the device and to facilitate calibration thereof.

In operation, the device 50 as shown in FIG. 2 functions to make or break the electrical circuit supplying power to the stator windings of an electric motor so as to enable operation of the motor or to prevent operation in the case of malfunction. Under normal operation of the electric motor, no overheating or increased current draw will occur and the device 50 will maintain the electrical connection to enable continued operation of the motor. Upon the occurrence of overheating due to a running overload or similar malfunction, the first cantilever arm 60 will respond to increased temperature by bending upwardly at its free end as shown by arrows 76. Upon upward movement of the cantilever arm 60, the bearing surface 74 will bear upon the tab 70 so as to apply an upward force to the shunt arm structure 64 which carries the second electrical contact 58. As temperature increases, continued upward movement of the cantilever arm 60 will eventually result in breaking of the electrical connection between the first and second contacts 54 and 58 to break the electrical circuit through the device 50 and render the motor momentarily inoperative. Upon breaking of the electrical circuit, the running overload condition will be eliminated and the motor will begin to cool accordingly. Due to the mass of the motor, the cooling time will vary, but in any event will gradually be reduced over a period of time. The cantilever arm 60 will thereafter return to its normal operating position, thereby reinstituting the normal operating position of the shunt arm 64 and correspondingly the second electrical contact 58 to remake the electrical circuit. Similar operation occurs upon a locked rotor condition.

It should be recognized that the locked rotor condition presents a significant safety hazard in use of the electric motor, and therefore it is desired to render the motor inoperative as quickly as possible. In a conventional motor which draws 6 amps under normal operation, a locked rotor condition will increase the amperage drawn by six to seven times resulting in a current of approximately 35 amps which will quickly result in heating of the shunt offset 68 as described. This heating will occur in approximately 3 to 4 seconds and subsequent operation of the motor protector to render to the motor inoperative will occur in approximately 8 to 13 seconds. In the known device, after initial breaking of the electrical circuit, the motor will remain inoperative for approximately 50 seconds which is the approximate cycle time of the device 50 known in the prior art. As previously stated, the cycle time of the prior art slow make/slow break device is not commensurate with the cycle time of a snap action type motor protector which has a cycle length of approximately 2½ minutes. It should also be recognized that under the 18 day UL testing requirements as previously described, the motor protector 50 known in the prior art must cycle repeatedly over the 18 day period wherein the device will be made to cycle over 30,000 times under UL testing. The shorter cycle time of the prior art slow make/slow break device acts to increase the total operating time of the protector in hours and days as compared to a snap action type device and may require further temperature calibration changes during the extended testing period. It should also be evident that the repeated frequent cycling imposed on the device under the UL testing requirements will have severe adverse effects upon the electrical contacts leading to a shorter useful life of the device.

Figure 3:
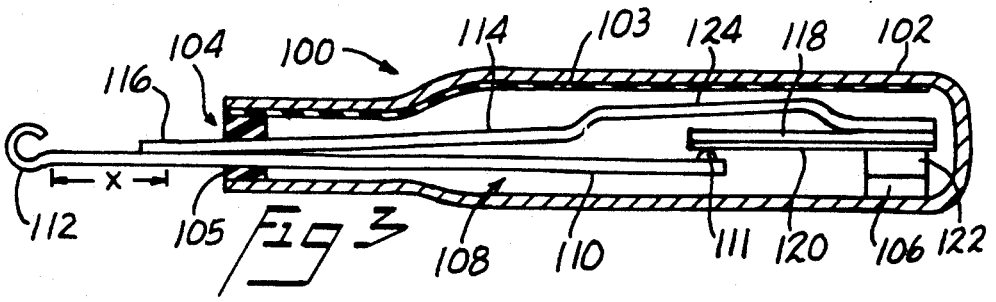
FIG. 3 shows an enlarged cross sectional view of the motor protector of the present invention under normal operation with electrical connection being made between the electrical contacts thereof.

Turning now to FIG. 3, there is shown a motor protector 100 in accordance with the present invention. The motor protector 100 includes some similar aspects to the prior art device as shown in FIG. 2, such as the outer housing 102 constructed of an electrically conductive material and having a first open end 104 therein. An electrical insulating layer 103 is provided at the upper portion of housing 102. Mounted in the housing 102 and electrically connected thereto is a first electrical contact 106 positioned adjacent at an opposed end of the housing 102 from the open end 104. Disposed through the open end 104 is a movable cantilever assembly generally designated as 108 which is electrically isolated from the housing 102 by means of insulating layer. 103 and insulating material 105 at open end 104. The cantilever assembly 108 may include a first major cantilever arm 110 positioned in movable relationship within the housing 102 and extending outwardly from the open end 104 to enable electrical connection to the electric motor circuit by means of a curl portion 112 formed at a first end thereof. Adjacent this first end is coupled a current carrying shunt arm 114 which also extends through the open end 104 of the housing 102 so as to be movably disposed in the housing. The current carrying shunt arm 114 is fixed in position relative to the first cantilever arm 110 by securing these arms together at a location 116 adjacent the first ends thereof. The electrical resistance of the device may be varied slightly by the location of connection 116. This variable positioning may be desirable in relation to the original locked rotor trip time desired. At the opposed end of the shunt arm 114 from its fixed position with respect to cantilever arm 110 is provided a second minor cantilever arm 118 which is fixed to the shunt arm 114 at its second end and extends toward the first end of the shunt arm 114 to a position between arms 110 and 114.

The first cantilever arm 110 is constructed of a material which exhibits predetermined characteristics in response to a physical variable. As previously described, a preferred material is a bi-metallic blade which due to the differential expansion of the metals therein will move in response to temperature differentials in its cantilever construction. The shunt arm 114 is preferably constructed of a material known as Iconel 600, which is commercially available, so as to act as a heater shunt. The Iconel 600 material is a special nickel content steel which has specific properties such as high resistance to the flow of a large electrical current as well as good spring temperature qualities to facilitate proper operation of the device. The second cantilever arm 118 is also constructed of a material which exhibits predetermined characteristics in response to a physical variable in a similar manner to first cantilever arm 110. The second cantilever arm 118 also carries on a bottom surface thereof a layer of insulating material 120 which may be a mica sheet or other similar material. The shunt arm 114 in conjunction with second cantilever arm 118 form an integral structure which carries a second electrical contact 122 thereon positioned relative to the first electrical contact 10 associated with the housing 102 to enable electrical connection to be made therebetween. In the preferred embodiment, the contacts 106 and 122 are formed from a special alloy which enables the useful life thereof to be lengthened and to provide better operating characteristics in the device 100. The contacts 106 and 122 may be composed of a 15% silver-cadmium oxide alloy which is a hardened alloy having special physical characteristics to provide advantages in the operation of the device. The alloy from which the contacts 106 and 122 are constructed acts to retard the flow of silver in the contact at high temperatures and thereby reduces pitting or transfer deposition from one contact to the other. The alloy also acts to reduce electrical arcing and thereby lengthens the contact life.

Another beneficial aspect of the construction of device 100 is the coating of the outer housing or case 102 with an iodine solution wherein the case contact 106 will also be coated on its upper face where it makes electrical connection with the contact 122. In the preferred embodiment, the inside of the case 102 and the electrical contact 106 are exposed to a 2% iodine solution for approximately 40 seconds after which the assembly will be flushed with distilled water. The coating of iodine which remains on the inside of the housing 102 and contact 106 acts to reduce arcing and extends the contact life in the assembly. By coating the case contact 106 with the iodine solution, the iodine will be vaporized in the region of electrical connection between the contacts 106 and 122 to inhibit arcing between the contacts until they are relatively closely spaced. The coating of the case contact 106 also improves functioning of the contacts by restricting the area where the first electrical connection is made between the contacts 106 and 122. Additionally, after electrical connection is made between the contacts, the iodine coating tends to maintain a centralized arc location between the contacts thereby enhancing the durability of the contacts and extending the life thereof.

Of particular importance in the device 100 as shown in FIG. 3, are the spatial relationships between the first and second cantilever arms 110 and 118 respectively as well as that of the shunt arm 114. Again, the shunt arm 114 includes a shunt offset portion 124 which is critically positioned with respect to the first and second cantilever arms 110 and 118 respectively. In the preferred embodiment, the first and second cantilever arms 110 and 118 will respond in a predetermined manner in response to temperature changes within a motor to enable breaking of the electrical circuit upon the occurrence of a malfunction resulting in overload of the motor.

Figure 4:
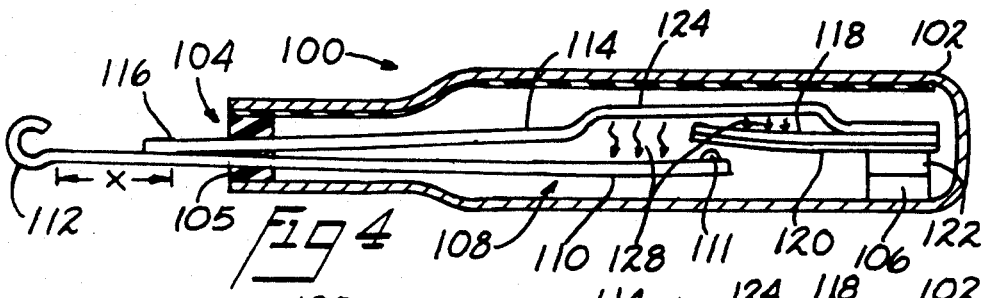
FIGS. 4–6 show enlarged cross sectional views of the motor protector as seen in FIG. 3 at various stages of the operation of the motor protector upon overheating or malfunction of the motor causing the motor protector to break the electrical connection between the contacts thereof.

The operation of the device 100 as shown in FIG. 3 has some similar characteristics to the operation of the prior art motor protector as shown in FIG. 2, but differs substantially in various aspects. As will be described with reference to FIGS. 4–6, upon the occurrence of motor overheating, the device 100 will break electrical connection between contacts 106 and 122. In FIG. 4, there is shown an initiation of a cycling operation in the device to break the electrical circuit and render the motor inoperative in response to a motor malfunction. As previously stated, with a locked rotor condition, it is desired to render the motor inoperative in a very short time to avoid any safety hazard presented thereby. The motor protector 100 is electrically connected in series with the stator windings of the electric motor. The path of electrical current proceeds through the current carrying shunt arm 114, and electrical continuity is cut off to both of the cantilever arms 110 and 118 by an insulating layer 120. The coupling location 116 of the shunt arm 114 to the first cantilever arm 110 as well as its connection to the second cantilever arm 118 at its opposed end act as heat sinks having good thermal conductivity such that upon increased current flow through the cantilever arm 114 results in heating thereof at a mid-point of its operating length. Thus, the cantilever arm 114 will be quickly heated upon a locked rotor condition at its point of least thermal conductivity which will be the offset portion 124 thereof. As shown in FIG. 4 by arrows 128, the heating of the offset portion 124 will conduct and radiate heat toward both the cantilever arms 110 and 118 which are responsive to temperature differentials to induce movement thereof. The shunt offset portion 124 of the shunt arm 114 has been positioned so as to effectively radiate heat toward both the cantilever arms 110 and 118 for proper and effective functioning thereof. The offset portion 124 of the shunt cantilever arm 114 will heat to a brilliant orange within 3 to 4 seconds upon a locked rotor condition, thereby immediately radiating heat to the cantilever arms 110 and 118 to initiate cycling of the device 100.

In the initial operation to break the electrical circuit as seen in FIG. 4, the two cantilever arms 110 and 118 will move upwardly in response to the heat radiated from the shunt offset portion 124. As the second cantilever arm 118 is shorter and of thinner cross section than the first cantilever arm 110, it will move upwardly at a somewhat faster rate initially. As seen in FIG. 4, the initial upward movement of the second cantilever arm 118 does not result in breaking of the connection between the electrical contacts 106 and 122 but does tend to angle the orientation of contact 122 slightly with respect to contact 106. As will be described in more detail hereinafter, the continued action of the second cantilever arm 118 in response to temperature differentials will result in a slight wiping action between the contacts 106 and 122 so as to help keep the contacts clean and to avoid welding of the contacts in the device.

Figure 5:
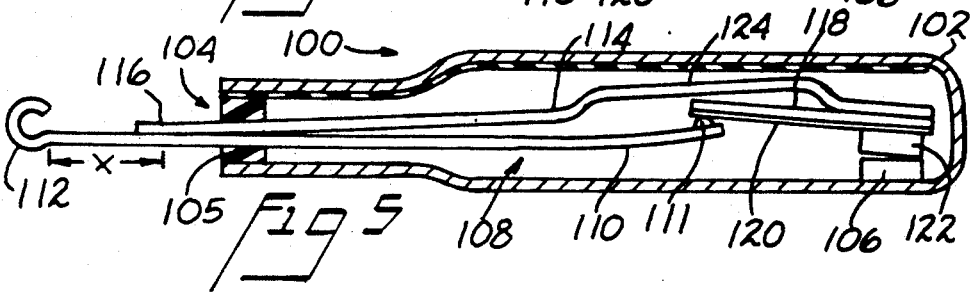

Turning now to FIG. 5, as upward movement of the cantilever arms 110 and 118 continue in response to heat radiated by the shunt offset portion 124, the upward movement of first cantilever arm 110 will gradually overtake the upward movement of second cantilever arm 118 due to the increased length thereof. When the upward movement of first cantilever arm 110 overtakes that of cantilever arm 118, the dimple or bearing point 111 of arm 110 will impose an upward force on arm 118 and therefore the shunt arm 114 and contact 122. Again it is seen that before actual breaking of the electrical connection between the contacts 106 and 122, the operation of the cantilever arms 110 and 118 will act to mechanically skew the orientation of the electrical contact 122 relative to the contact 106.

Figure 6:
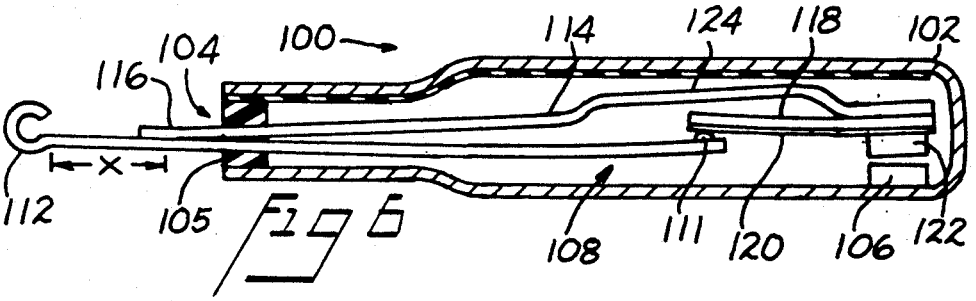

Turning now to FIG. 6, actual breaking of the electric circuit will result upon further upward movement of the first cantilever arm 110. In this way, the electrical contacts 106 and 122 are physically separated so as to break the connection therebetween and render the motor inoperative. The device 100 will operate to break the electrical circuit within the normally desired 5 to 10 seconds, which is faster than the prior art device as seen in FIG. 2 and therefore more effective.

In another aspect of the device as shown in FIG. 3, the distance between the curl portion 112 and the point of coupling 116 between the cantilever arms 110 and 114 shown by the distance "x", acts to regulate the resistance introduced into the electrical circuit by the cantilever shunt arm 114 in the construction. By modifying the distance "x" in the construction, the device can be made to develop faster or slower trip times being the time it takes the electrical circuit to be broken in the event of a locked rotor condition or similar event. As an example, the distance "x" which may be termed a shunt distance can be extended toward the curl 112 so as to add additional resistance to the electrical circuit in order to develop a faster locked rotor trip time. This of course will be the normal situation wherein it is desired to break the electrical circuit very quickly in the event of a locked condition or similar malfunction in the motor. This is accomplished by providing higher electrical resistance in the shunt cantilever arm 114 such that the shunt offset portion 124 will be more quickly heated so as to radiate heat to the bi-metal cantilever arms 110 and 118 to affect breaking of the circuit. It should of course be recognized that the distance "x" or the shunt distance can be extended away from the curl portion 112 so as to reduce the electrical resistance imposed in the electrical circuit for a slightly longer trip time if desired.

Although the breaking of the circuit as seen in FIGS. 4–6 is achieved quickly and efficiently by the device as desired, the construction also importantly acts to induce a delay in the device upon subsequent cooling of the electric motor and motor protector 100. Thus, after opening of the electrical contacts 106 and 122 as seen in FIG. 6, the electrical current to the shunt arm 114 will be cut off and the shunt offset portion 124 will begin to cool in conjunction with the motor in which it is used. Due to the mass of the motor, the cooling effect will be slow such that the cantilever arms 110 and 118 will also cool slowly subsequent to breaking of the electrical circuit. As the cantilever arms 110 and 118 cool, a reverse action to that shown in FIGS. 4–6 is initiated. The reverse action acts to induce a significant delay in the cycle time of the device 100 and can be seen with reference to FIG. 7.

Figure 7:
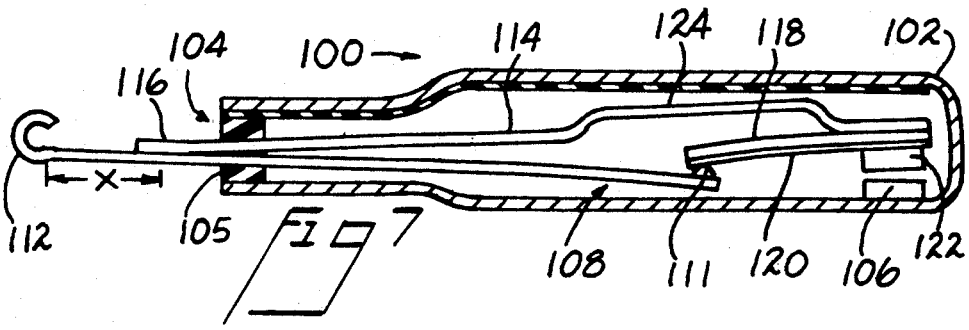
FIG. 7 shows an enlarged cross-sectional view of the motor protector as seen in FIG. 3 upon initial cooling of the motor and motor protector after the electrical connection between the contacts has been broken.

In FIG. 7, with the electric current to the shunt arm 114 cut off, there is imposed an actual operating opening verses closing temperature differential as the assembly cools. The relative ratio of the operating lengths of the cantilever arms 110 and 118 impose a delay action into the return movement of the cantilever arms to the normal operating position. Due to the increased length of the first cantilever arm 110, this arm will cool more slowly than second cantilever arm 118 such that it is made to act upon the shorter cantilever arm 118 at its bearing point 111 to oppose the more rapid downward movement of second cantilever arm 118 due to its thinner section. In this way, the shunt arm 114 and second cantilever arm 118 carrying the contact 122 is essentially maintained in its open condition as seen in FIG. 7 during initial cooling. The opposed action of the cantilever arms 110 and 118 due to the different operating lengths and velocity of movement thereof will induce a delay in the closing action of the cantilever assembly 108 so as to dramatically increase the cycle time of the device. A similar effect can also be obtained by constructing the cantilever arms 110 and 118 of different materials wherein they will respond to a change of a physical variable differently, and will work in conjunction with one another to introduce the desired delay action.

As referred to hereinbefore, in operation of the device to break the circuit there is provided a wiping action between the electrical contacts 106 and 122 resulting in better operating characteristics and increased contact life. Upon radiating heat from the shunt offset 124 toward cantilever arms 110 and 118 positioned thereunder, the initial upward movement of the cantilever arm 118 will out pace the upward movement of the cantilever arm 110 such that the angle of the lower plane of the electrical contact 122 changes with respect to the upper plane of electrical contact 106. It has been found that the wiping motion imparted to the movable contact 122 by the movement of the cantilever arm 118 creates beneficial aspects in the breaking of the electrical connection between the contacts 106 and 122. It has been a problem in the prior art that the electrical contact life has been limited by the rugged performance characteristics imposed thereon during cycling of the device 100 to break the electrical circuit. The wiping action imparted to the movable contact 122 in the construction of the present invention tends to help keep the contacts clean and in preventing electrical welding between the contacts 106 and 122. The physical motion imparted to the movable contact 112 while still electrically connected with contact 106 results in extending the useful life of the electrical contacts and facilitates prevention of failure of the device from contact welding. Along with the extended cycle rate of the device 100, the wiping action imparted by the structure creates an extremely beneficial construction which optimizes the operating characteristics of the device.

Figure 8:
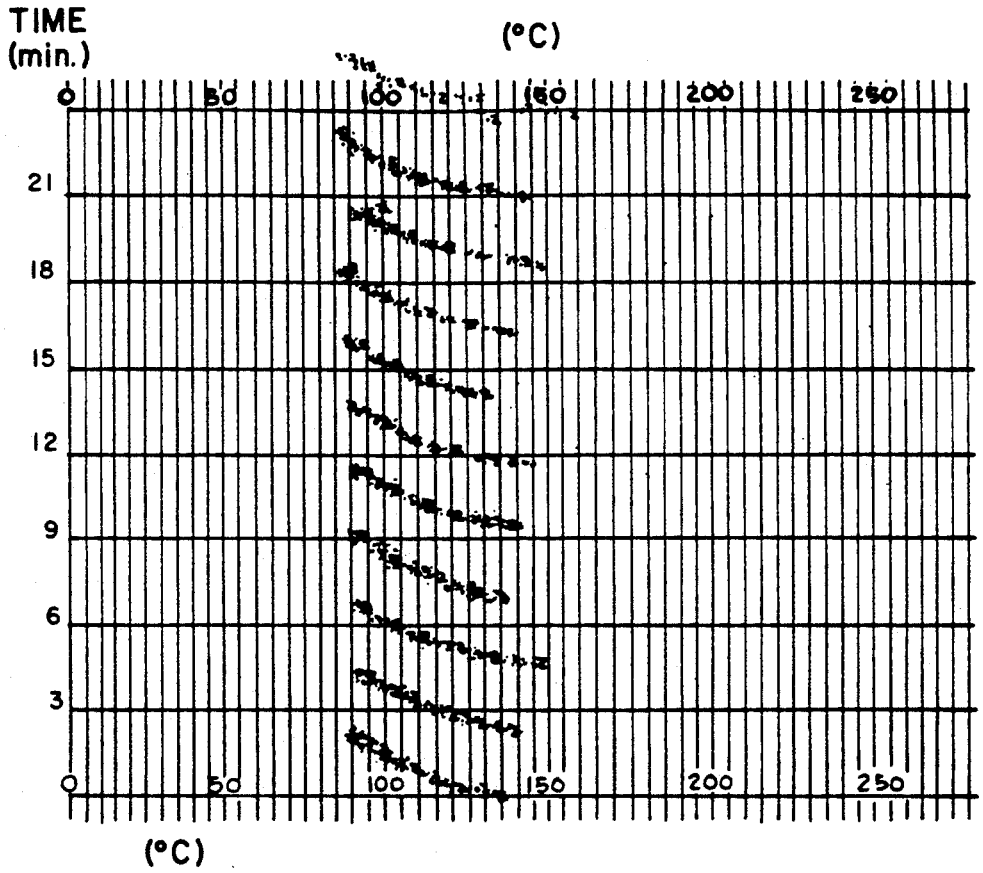
FIG. 8 shows a graph representing a number of cycles of the motor protector as seen in FIG. 3 as tested on an electric motor having a locked rotor condition, and showing the performance characteristics of the motor protector.

Turning now to FIG. 8, there is shown a graph of a number of cycling repetitions of a device constructed in accordance with the invention. The cycling graph represents cycling of the device as would be required under the UL 18-day testing requirements for a locked rotor condition. As seen in FIG. 8, each series of dots indicate measured temperatures of a motor over time, with time being indicated on the vertical axis. Each series of dots represents a cycle of the motor protector, from making of the electrical connection which supplies electric current to the motor, to the breaking of the circuit to allow cooling. The on-time temperature differential under a locked rotor condition of the electric motor varies from approximately 85° C. to 160° C. within a period of about 5 seconds. After this short time period, the electrical circuit is broken at the locked rotor induced heat peaks and then begins a long cooling period resulting in a total elapsed cycle time of approximately 2–2½ minutes. The electric motor is rendered electrically inoperative during this extended cooling time period. As previously stated, the on-time of the motor in a locked rotor condition is very critical as the peak temperatures cannot exceed those set by the UL requirements as previously described. Thus, the electrical on-time of an electric motor using the motor protector of the present invention is typically 1 to 3 seconds with the actual heating occurring during this short time period. The motor protector of the present invention therefore acts as a mechanical and thermal stop watch which will break the electrical circuit of the motor before the peak temperatures under the UL standards are surpassed. It should also be recognized that the increased cycle time of the device facilitates lengthening the operating life thereof. The increased cycle time will act to lengthen the life of the electrical contacts since they will not be making and breaking the electrical circuit nearly as many times as the prior art device. Additionally, the increased cycle time facilitates additional cooling of the silver within the contacts which also acts to increase their useful life.

It should be evident that the motor protector of the present invention provides a significantly improved slow make/slow break device as compared to the prior art which had a significantly shorter cycle rate. The cycle time which can be achieved by the construction of the motor protector 100 is between 2 and 2½ minutes which is commensurate with the desired cycle time for such devices and that which has been achieved by snap action type devices. The increase in the individual cycle time relative to the prior art slow make/slow break device will substantially increase the total number of cycles during the 18 day UL testing period and will also diminish the calibration temperature change during that period. Although the preferred embodiment of the present invention have been disclosed herein, it will be appreciated that modification of this particular embodiment may be resorted to without departing from the scope of the invention as found in the appended claims.

What is claimed is:

1. An electric motor circuit breaker comprising;

a housing being constructed of an electrically conductive material having a first electrical contact disposed therein, a cantilever assembly disposed in said housing including first and second bimetal arms constructed of a material exhibiting predetermined characteristics in response to temperature, and a shunt arm being constructed of an electrically conductive material and having first and second ends and an offset portion therebetween, wherein said first bimetal arm and said shunt arm are coupled adjacent said first end and are fixed with respect to said housing so as to extend therein, said second bimetal arm and said shunt arm being coupled at said second end with said second bimetal arm extending between said first bimetal arm and said shunt arm to a location adjacent said offset portion of said shunt arm, a second electrical contact electrically coupled to said shunt arm at said second end and positioned relative to said first contact to enable electrical connection to be made therebetween, wherein upon malfunction of said motor, said offset portion of said shunt arm will be heated and said first and second bimetal arms will act in conjunction with one another in response to the rise in temperature, with said second bimetal arm having a shorter operative length and a thinner cross-section than said first bimetal arm such that upon heating of said first and second bimetal arms, said second bimetal arm will move more quickly and movement of said first bimetal arm will overtake movement of said second bimetal arm due to its longer operative length to result in breaking the connection of said first and second electrical contacts, and wherein a subsequent decrease in temperature will result in said second bimetal arm moving more quickly in response to said decrease in temperature and said first bimetal arm will act to oppose the movement of said second bimetal arm to delay the remaking of the electrical connection between said first and second electrical contacts.

2. An electric motor circuit breaker as in claim 1, wherein, said first and second bimetal arms are constructed of at least two metallic layers which exhibit different expansion characteristics in response to variations in temperature such that changes in temperature will produce relative movement of said first and second bimetal arms dependent on said operating lengths, and the cross-section thereof, so as to move said second contact into and out of electrical connection with said first contact.

3. An electric motor circuit breaker as in claim 1, wherein, said shunt arm is constructed of a material which has high electrical resistance to facilitate heating thereof in response to increased electrical current flowing therethrough.

4. An electric motor circuit breaker as in claim 1, wherein, said shunt arm is constructed of a material which exhibits good spring temper quality so as to maintain its rigidity upon heating thereof in response to electrical current flowing therethrough.

5. An electric motor circuit breaker as in claim 1, further comprising, a layer of insulating material disposed on said second bimetal arm so as to electrically isolate said first and second bimetal arms.

6. An electric motor circuit breaker as in claim 1, further comprising, a layer of insulating material disposed in said housing so as to electrically isolate said housing from said shunt arm.

7. An electric motor circuit breaker as in claim 1, wherein, said housing and said first electrical contact are coated with iodine solution so as to inhibit electrical arcing.

8. An electric motor circuit breaker as in claim 1, wherein, said first bimetal arm is constructed of an electrically conductive material and extends outwardly from said housing to be connected in series with the electrical circuit of the electric motor, wherein said electrical circuit is completed by electrically coupling said first and second electrical contacts.

9. An electric motor circuit breaker as in claim 1, wherein, said first bimetal arm is constructed of an electrically conductive material and is coupled in series with the electrical circuit of the electric motor at a first end thereof and said shunt arm is electrically coupled to said first bimetal arm at a predetermined distance from said first end of said first bimetal arm wherein said distance can be varied to change the electrical resistance produced by said shunt arm in the electrical circuit.

10. An electric motor circuit breaker as in claim 1, wherein, upon heating of said offset portion of said shunt arm, the relative removement of said second bimetal arm relative to said first bimetal arm will result in movement of said second electrical contact relative to said first electrical contact without breaking of the electrical connection therebetween, so as to create a wiping action between said first and second electrical contacts.

11. An electric motor circuit breaker as in claim 1, wherein, the coupling of said shunt arm to said first bimetal arm at said first end and said second bimetal arm at said second end provide heat sinks at said first and second end of said shunt arm, such that upon increased current flow through said shunt arm will result in heating at said offset portion thereof.

12. An electric motor circuit breaker as in claim 1, wherein, said second bimetal arm extends to said position ajacent said offset portion of said shunt arm, and extends to approximately the center of said offset portion, such that said offset portion of said shunt arm will radiate heat toward both said first and second bimetal arms in a substantially uniform manner.

* * * * *